US006280061B1

(12) United States Patent
Kokado

(10) Patent No.: US 6,280,061 B1
(45) Date of Patent: Aug. 28, 2001

(54) HALOGEN LAMP WITH REFLECTOR

(75) Inventor: Haruo Kokado, Hyogo-ken (JP)

(73) Assignee: Phoenix Electric Co., Ltd., Himeji (JP)

( * ) Notice: Subject to any disclaimer, the term of this patent is extended or adjusted under 35 U.S.C. 154(b) by 0 days.

(21) Appl. No.: 09/442,644

(22) Filed: Nov. 18, 1999

(30) Foreign Application Priority Data

Nov. 26, 1998 (JP) ..... 10-336057

(51) Int. Cl.[7] ..... F21V 7/00

(52) U.S. Cl. ..... 362/296; 362/267; 362/444; 313/318.08; 313/318.11; 313/579; 313/113

(58) Field of Search ..... 362/226, 267, 362/263, 296, 306, 308, 255, 341, 444; 313/318.08, 318.09, 318.1, 318.11, 579, 525, 113

(56) References Cited

U.S. PATENT DOCUMENTS 4,528,619 * 7/1985 Dolan ..... 362/519
5,053,935 * 10/1991 Hellwig ..... 362/296
5,206,799 * 4/1993 Tiesler ..... 362/296

* cited by examiner

*Primary Examiner*—Alan Cariaso
*Assistant Examiner*—Hargobind S. Sawhney
(74) *Attorney, Agent, or Firm*—Oblon, Spivak, McClelland, Maier & Neustadt, P.C.

(57) ABSTRACT

A halogen lamp with reflector which allows a pinch seal portion to be fitted onto a lamp mount portion of a reflector simply by inserting a lamp body with a pinch seal support and a lead rod support into the lamp mount portion, thrashes the cost and prevents an inorganic adhesive from contaminating a concave reflecting section of the reflector, and is suitable for achieving high wattage. An insulating lead rod support (5) is mounted to lead rods (1*b*), and a pinch seal support (4) is mounted to the pinch seal portion (1*a*). The lead rod support (5) is inserted into a bottom aperture (3*b*) of the lamp mount portion (3). The pinch seal support (4) includes an insertion hole (4*d*) for passing the pinch seal portion (1*b*) therethrough, pinch seal abutting pieces (4*b*), reflector abutting pieces (4*a*), and an opening closing portion (4*c*) closing the front opening (6). An adhesive (8) is injected into a gap between the pinch seal portion (1*b*) and the lamp mount portion (3).

3 Claims, 5 Drawing Sheets

HALOGEN LAMP WITH REFLECTOR

BACKGROUND OF THE INVENTION

1. Field of the Invention

The present invention relates to a halogen lamp with reflector.

2. Description of the Prior Art

FIG. 5 is a cross sectional view of a conventional halogen lamp with reflector.

Referring to FIG. 5, the conventional halogen lamp with reflector includes a halogen lamp body (11) and a reflector (12) in which the halogen lamp body (11) is disposed at a center thereof.

The halogen lamp body (11) includes a pinch seal portion **(11*a*)**.

Lead rods **(11*b*) connected to a filament (16) in the halogen lamp body (11) are drawn out from the pinch seal portion (11*a*)** to the outside.

A rearwardly protruding lamp mount portion (13) of the reflector (12) is disposed at the center of the reflector (12), and the pinch seal portion **(11*a*) of the halogen lamp body (11) is inserted into the lamp mount portion (13) and fixed by an inorganic adhesive (14)**.

In the conventional halogen lamp with reflector, a method of mounting the halogen lamp body (11) onto the reflector (12) is as follows.

First, the pinch seal portion **(11*a*) of the halogen lamp body (11) is inserted into the lamp mount portion (13) disposed at the center of the reflector (12)**.

Then, the halogen lamp body (11) is focalized by a three-dimensional and oscillating movement. When the halogen lamp body (11) is focalized, an inorganic adhesive (14) is injected into a gap between the pinch seal portion **(11*a*) and the inside surface of the lamp mount portion (13) through an injection aperture (15*a*) disposed in a release paper (15) stuck so as to close a bottom aperture (13*a*) of the lamp mount portion (13)**.

The halogen lamp body (11) is held until the inorganic adhesive (14) is dried and hardened to some extent and is capable of holding the halogen lamp body (11).

Lastly, the release paper (15) is peeled off, and the inorganic adhesive (14) is calcined. Thus, the halogen lamp body (11) is fixed onto the reflector (12) in the conventional method.

In this case, as will be understood from FIG. 5, the inorganic adhesive (14) immediately after its injection is soft and also the pinch seal portion **(11*a*) buried in the inorganic adhesive (14) is not supported anywhere. Therefore, the halogen lamp body (11) must be kept being held until the inorganic adhesive (14)** is dried and hardened to some extent, rendering it inefficient to produce the lamp with reflector.

Moreover, if the front opening **(13*b*) of the lamp mount portion (13) on the concave reflecting section (12*a*) side of the reflector (12) is fully filled with the inorganic adhesive (14) in injecting the inorganic adhesive (14) into the gap between the pinch seal portion (11*a*) and the inside surface of the lamp mount portion (13), the inorganic adhesive (14) overflows into the concave reflecting section (12*a*)**, thereby deteriorating the appearance and also increasing the random reflection.

This raises a problem that, when the lamp is incorporated in a device for use as a product, the focalization is difficult in the device in which the lamp is incorporated.

Further, unless the bottom aperture **(13*a*) for injecting the inorganic adhesive (14) is closed by a release paper (15), the inorganic adhesive (14) overflows also through the bottom aperture (13*a*)**, thereby deteriorating the appearance.

Furthermore, if a release paper (15) is used, it adds to the costs itself and also human labor is needed in sticking, releasing, and discarding the release paper (15), thereby further increasing the costs.

Another important feature, although not illustrated, is a fact that, in conventional lamps, only a part of the gap is filled with the inorganic adhesive (14) for fear that the inorganic adhesive (14) overflows through the front opening **(13*b*) on the concave reflecting section (12*a*) side of the reflector (12)**, as mentioned above.

As a result of this, the heat in activating the lamp is not sufficiently conducted from the pinch seal portion **(11*a*) to the lamp mount portion (13) of the reflector (12), raising a problem that the halogen lamp body (11)** tends to be heated too much and, in the case of a high wattage halogen lamp, the lamp cannot withstand the heat unless the lamp is forcibly cooled by means of a fan.

SUMMARY OF THE INVENTION

A first object to be achieved by the present invention is to allow the pinch seal portion to be provisionally fitted onto the lamp mount portion simply by inserting the halogen lamp body with a pinch seal support and a lead rod support into the lamp mount portion of the reflector and to eliminate the need for holding the lamp body after injection of the inorganic adhesive.

A second object to be achieved by the present invention is to prevent deterioration of the appearance and difficult focalization caused by the injected inorganic adhesive.

A third object to be achieved by the present invention is to make available the use of a high wattage halogen lamp by improving the heat conduction from the pinch seal portion to the lamp mount portion of the reflector.

As an embodiment to achieve the aforementioned objects of the invention, in a halogen lamp with reflector according to the present invention, a lead support mounted to a bottom aperture of a lamp mount portion of a reflector closes the bottom aperture; lead rods of the halogen lamp body are held by the lead support by being inserted into the lead support;

an opposite opening on the concave reflecting section side of the reflector is closed by a pinch seal support mounted onto the pinch seal portion of the halogen lamp body; and the pinch seal portion is fixed at a predetermined position in the lamp mount portion by the pinch seal support.

Owing to this construction, the pinch seal support holds the pinch seal portion at a predetermined position in the lamp mount portion, and the lead rod support holds the lead rods at predetermined positions in the bottom aperture of the lamp mount portion, whereby the halogen lamp body is provisionally fixed at a predetermined position in the reflector.

This eliminates the need for holding the halogen lamp body until the inorganic adhesive is hardened to some extent after the inorganic adhesive is injected into a gap between the inner side of the lamp mount portion and the pinch seal portion. Therefore, work can be successively carried out and the productivity of the halogen lamp with reflector according to the present invention is improved.

Further, since the pinch seal support can stop the adhesive from overflowing through the front opening of the lamp mount portion to the outside, the surface of the concave reflecting section is not contaminated even if a sufficient amount of adhesive is injected.

Thus, since a sufficient amount of adhesive can be injected into a gap between the pinch seal portion and the inside of the lamp mount portion, heat conduction between the pinch seal portion and the lamp mount portion of the reflector is improved, whereby a high wattage lamp can be produced due to good heat release even without forcible cooling.

A more complete appreciation of the invention and many of the attendant advantages thereof will be readily obtained as the same becomes better understood by reference to the following detailed description when considered in connection with the accompanying drawings, wherein:

DETAILED DESCRIPTION OF THE PREFERRED EMBODIMENTS

Figure 1:
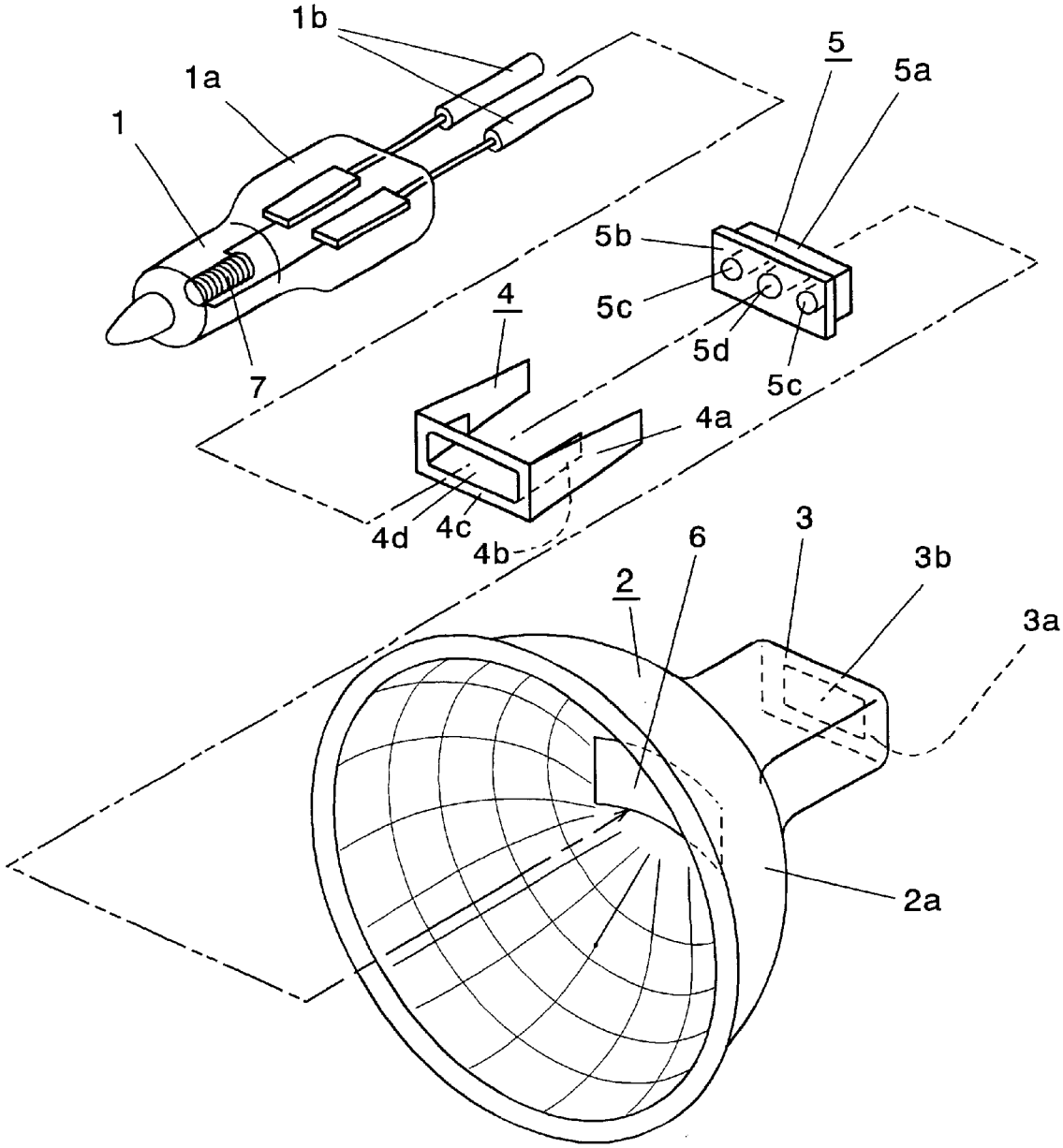
FIG. 1 is an exploded perspective view showing construction components of an embodiment of the present invention.
Figure 2:
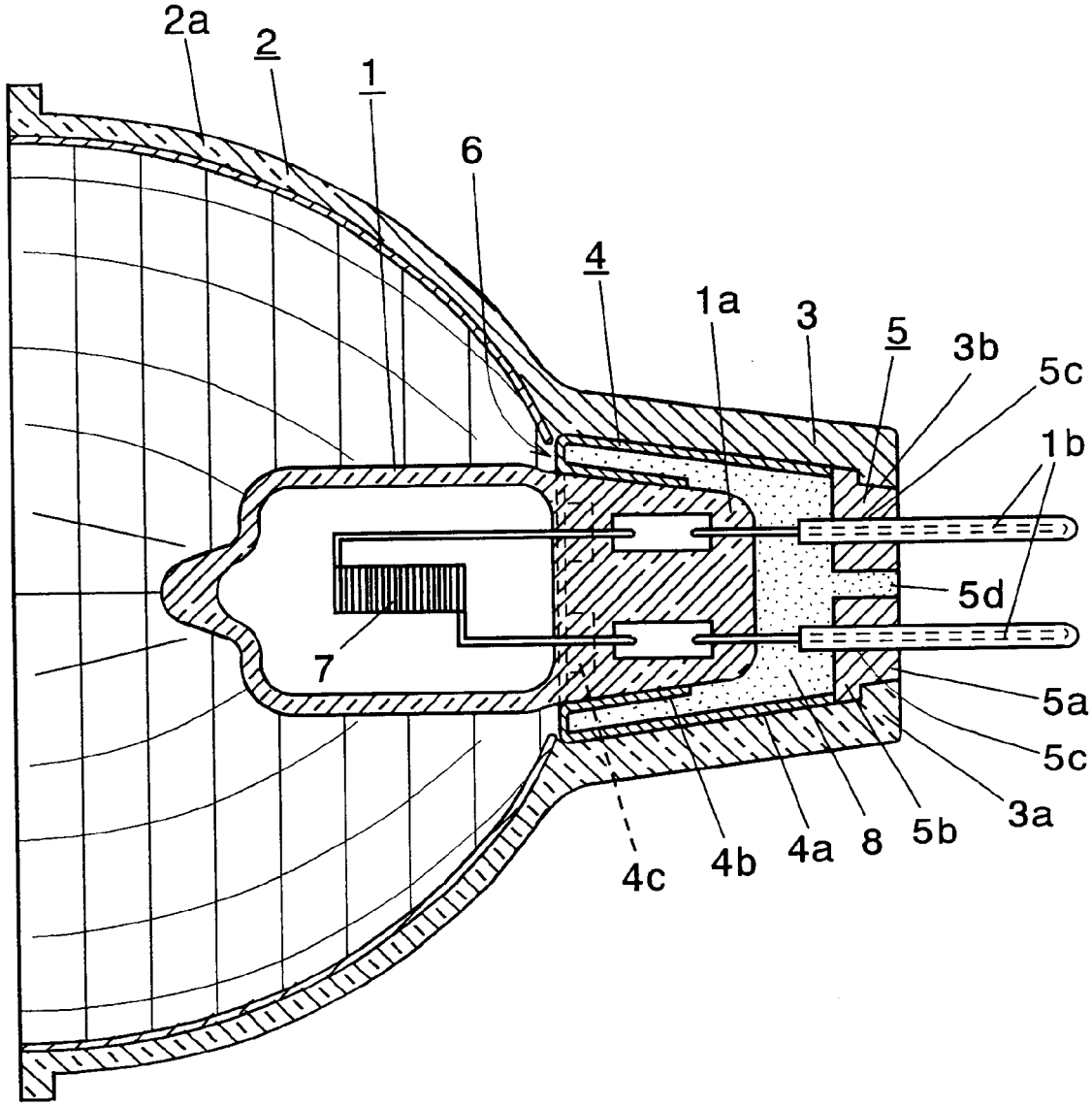
FIG. 2 is a vertical cross sectional view of the embodiment.
Figure 3:
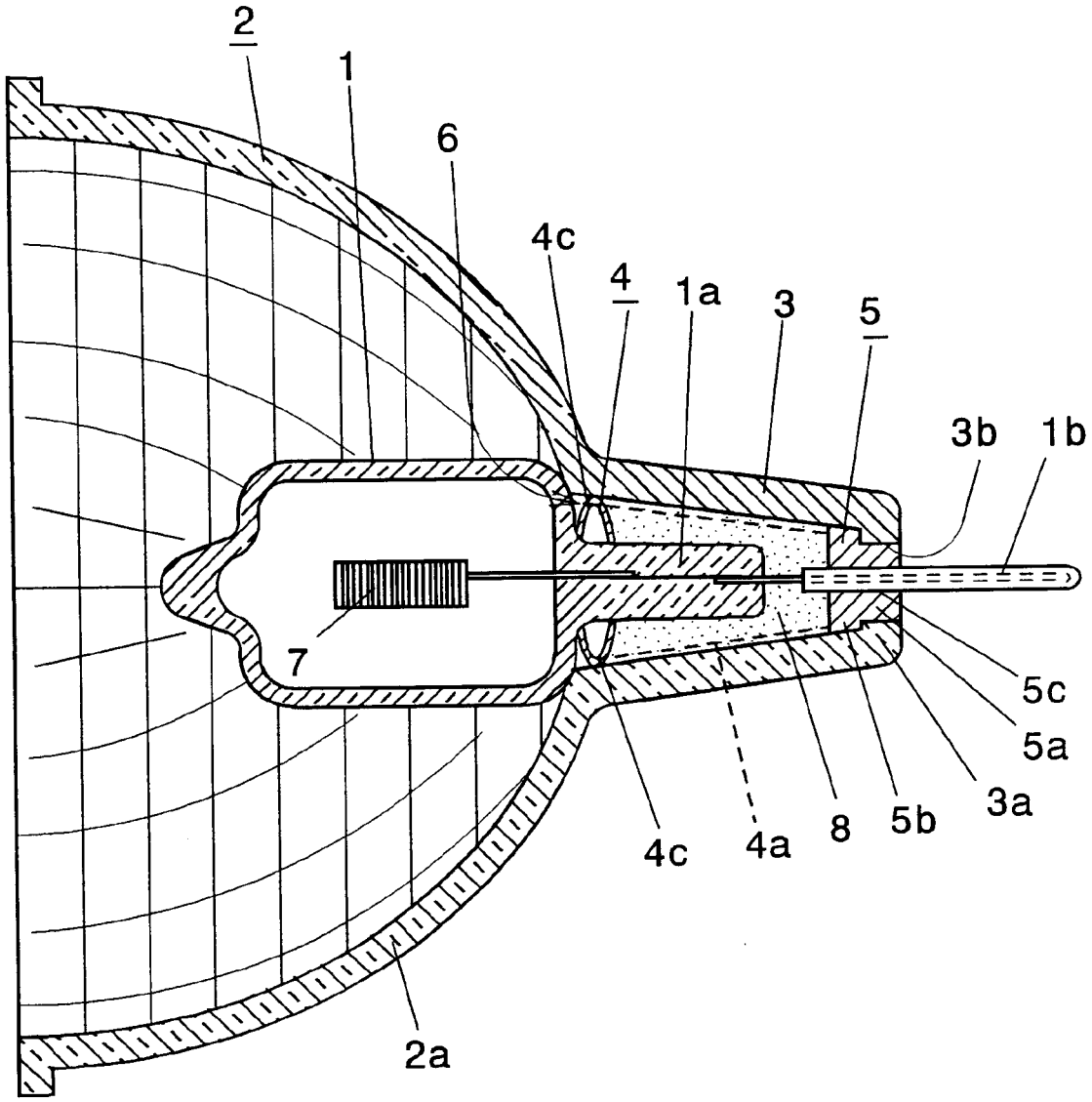
FIG. 3 is a lateral cross sectional view of the embodiment.
Figure 4:
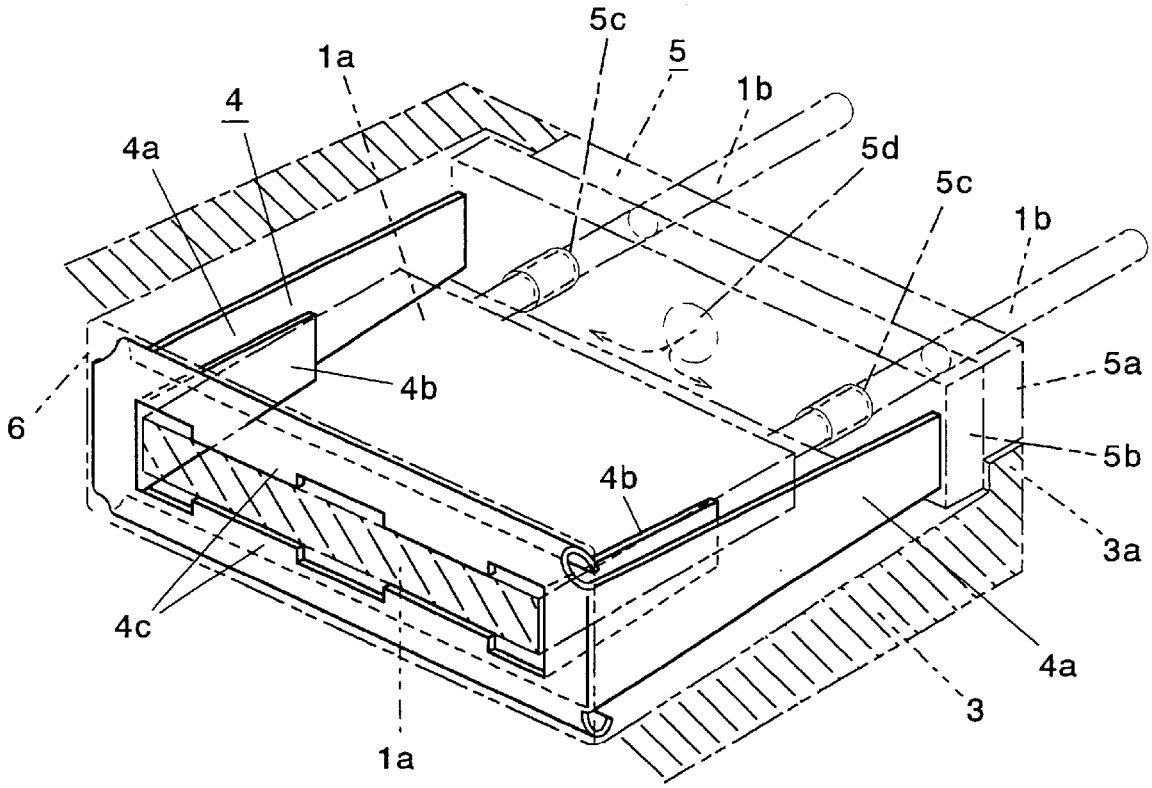
FIG. 4 is a view showing an essential part of the embodiment.
Figure 5:
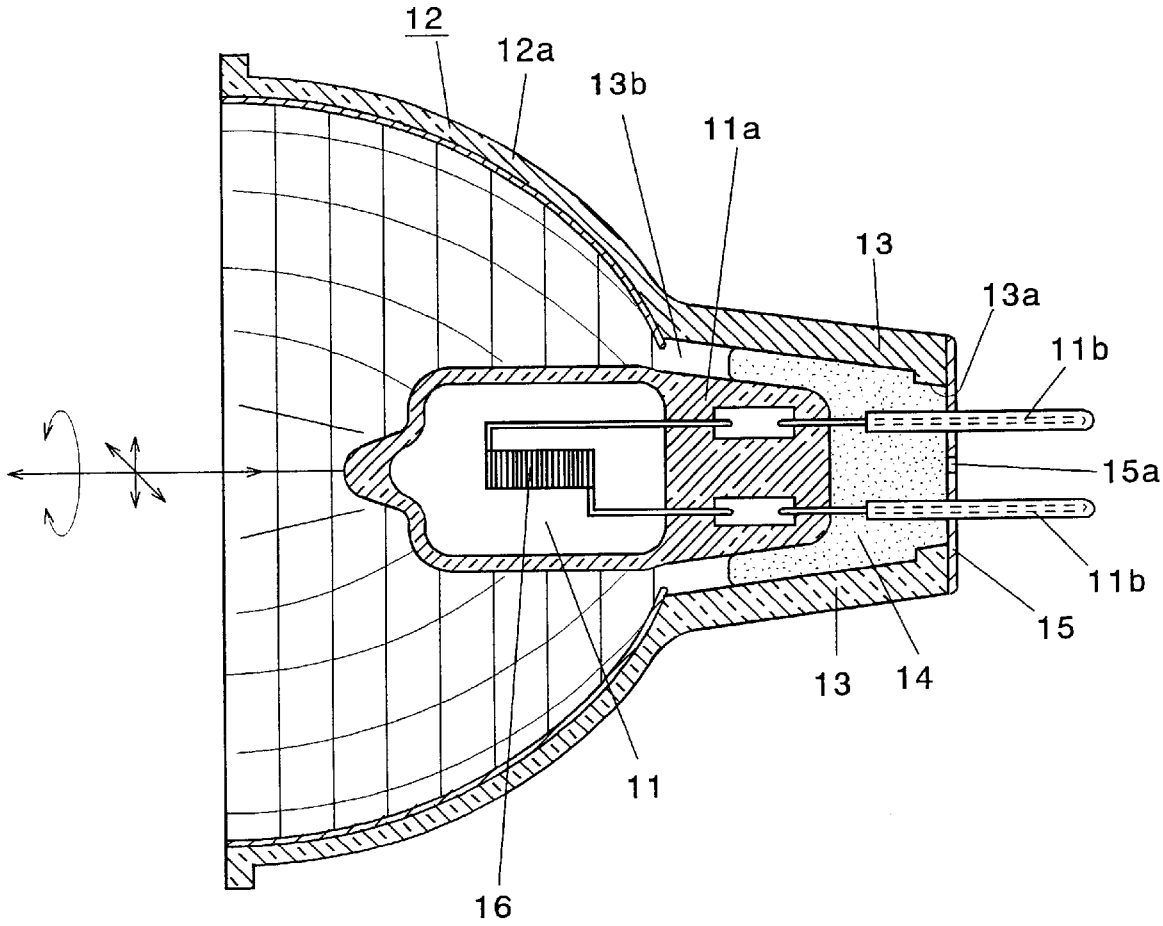
FIG. 5 is a cross sectional view of a conventional halogen lamp with reflector.

FIG. 1 is a view showing construction components of an embodiment of the present invention; FIG. 2 is a vertical cross sectional view of the embodiment; FIG. 3 is lateral cross sectional view of the embodiment; and FIG. 4 is a view showing an essential part of the embodiment.

A halogen lamp with reflector according to the present invention includes a halogen lamp body (1) and a reflector (2) having a lamp mount portion (3) for fixing the halogen lamp body (1) at its center.

The halogen lamp body (1) used in this embodiment is a single-end type halogen lamp body (of course, a double-end type halogen lamp body (1) may also be used). The single-end type halogen lamp body (1) includes a pinch seal portion (1*a*) at one end portion and a light-emitting bulb section at another end portion in which a filament (7) is installed. The filament (7) is connected to lead rods (1*b*) protruding from the pinch seal portion (1*a*) to the inside of the light-emitting bulb section, via a pair of molybdenum metal foils buried in the pinch seal portion (1*a*).

The reflector (2) is made of glass and includes a concave reflecting section (2*a*) and a lamp mount portion (3) disposed at a center of the concave reflecting section (2*a*) to protrude rearward and integrally therewith.

A reflecting film is formed by plating, vapor deposition, or chemical reaction on the inner surface of the concave reflecting section (2*a*).

The lamp mount portion (3) is a hollow prismatic body having an inner dimension decreasing a little toward its rear end. The lamp mount portion (3) includes a front opening (6) that opens at the center of the concave reflecting section (2*a*) and a bottom aperture (3*b*) at the bottom thereof.

The pinch seal support (4) is made by processing a metal plate such as a stainless steel plate or a brass spring plate.

The pinch seal support (4) includes an opening/closing portion (4*c*) having a rectangular insertion hole (4*d*) disposed at a center thereof for inserting the pinch seal portion (1*a*) of the halogen lamp body (1), reflector abutting pieces (4*a*) bent from the two shorter sides of the opening/closing portion (4*c*) to abut or to be in elastic contact with an inner surface of the shorter sides of the lamp mount portion (3), and pinch seal abutting pieces (4*b*) extending from the two shorter sides of the insertion hole (4*d*) and bent in the same direction as the reflector abutting pieces (4*a*) to abut the pinch seal portion (1*a*) from both sides thereof.

As will be understood from FIG. 2, the reflector abutting pieces (4*a*) have a length such that, when a later-mentioned lead rod support (5) is inserted into the bottom of the lamp mount portion (3), the tip ends of the reflector abutting pieces (4*a*) abut the lead rod support (5) and the opening/closing portion (4*c*) closes the front opening (6) formed at the center of the concave reflecting section (2*a*) of the reflector (2).

The outer dimension of the opening/closing portion (4*c*) is approximately equal to the inner dimension of the front opening (6) formed at the center of the concave reflecting section (2*a*) of the reflector (2). The insertion hole (4*d*) is approximately equal to the cross section of the pinch seal portion (1*a*) so as to support the pinch seal portion (1*a*) inserted into the insertion hole (4*d*). Therefore, the front opening (6) is completely closed by the opening/closing portion (4*c*) and the pinch seal portion (1*a*) inserted into the opening/closing portion (4*c*). Here, since the pinch seal portion (1*a*) is supported by the insertion hole (4*d*) as described above, the pinch seal abutting pieces (4*b*) are not necessarily needed. However, by providing the pinch seal abutting pieces (4*b*) and allowing the pinch seal portion (1*a*) to be held by the pinch seal abutting pieces (4*b*), the lamp body (1) is prevented from shifting or slipping off in the operation of injecting the inorganic adhesive (8) and subsequent operations. (4*b*) are not necessarily needed. However, by providing the pinch seal abutting pieces (4*b*) and allowing the pinch seal portion (1*a*) to be held by the pinch seal abutting pieces (4*b*), the lamp body (1) is prevented from shifting or slipping off in the operation of injecting the inorganic adhesive (8) and subsequent operations.

Also, the pinch seal support (4) can be provisionally fixed in the lamp mount portion (3) by the reflector abutting pieces (4*a*) being in elastic contact with the inner surface of it (3).

The lead rod support (5) includes two lead rod through-holes (5*c*) for passing the two lead rods (1*b*) of the lamp body (1), and an adhesive injecting hole (5*d*) formed therebetween for injecting an adhesive (8).

A step portion is formed on the periphery of the lead rod support (5), whereby the lead rod support (5) includes a rectangular insertion section (5*a*) having approximately the same planar dimension as the inner dimension of the bottom aperture (3*b*) of the lamp mount (3), and a bottom abutting section (5*b*) having approximately the same planar dimension as the inner dimension of the bottom portion (3*a*) of the lamp mount portion (3).

Although the inner diameter of the lead rod through-holes (5*c*) is a little larger than the outer diameter of the lead rods (1*b*) of the lamp body (1), they are formed to have dimensions such that the inorganic adhesive (8) may not leak out from the gap thereof in a later-mentioned step of injecting the inorganic adhesive (8).

[Assemblage]

The assemblage is performed as follows. First, the pinch seal support (4) is fitted onto the pinch seal portion (1*a*) of the lamp body (1). In fitting the pinch seal support (4), the pinch seal portion (1*a*) of the lamp body (1) is inserted into the insertion hole (4*d*) from the side where the lead rods (1*b*) protrude.

This allows the pinch seal portion (1*a*) to pass through the insertion hole (4*d*). However, since the bulb section has a cross section larger than an inner diameter of the insertion hole (4*d*), the bulb section cannot pass through the insertion hole (4*d*) and abuts the insertion hole (4*d*). Therefore, the insertion of the pinch seal portion (1*a*) of the lamp body (1) into the pinch seal support (4) is completed when the insertion hole (4*d*) reaches the bulb section.

When the insertion of the lamp body (1) is completed, the pinch seal abutting pieces (4*b*) abut the pinch seal portion (1*a*), thereby holding the pinch seal portion (1*a*) from both sides thereof Then, the lead rod support (5) is fitted onto the lead rods (1*b*). The two lead rods (1*b*) are allowed to pass respectively through the lead rod through-holes (5*c*) disposed in the lead rod support (5), thereby allowing the lead rods (1*b*) to protrude to the outside.

Next, the lamp body (1) having the pinch seal support (4) and the lead rod support (5) fitted thereon is inserted and fitted into the lamp mount portion (3) of the reflector (2).

In this state, the reflector abutting pieces (4*a*) of the pinch seal support (4) abut the inside of the lamp mount portion (3), and the opening/closing portion (4*c*) of it (4) closes the front opening (6) of the lamp mount portion (3) on the concave reflecting section (2*a*) side.

As for the lead rod support (5), its insertion section (5*a*) is inserted into the bottom aperture (3*b*) of the bottom portion (3*a*), and its bottom abutting section (5*b*) abuts the bottom portion (3*a*). Here, as shown in FIG. 2, since the insertion section (5*a*) of the lead rod support (5) has approximately the same planar dimension as the inner dimension of the bottom aperture (3*b*) of the bottom portion (3*a*), the insertion section (5*a*) fittingly slides into the bottom aperture (3*b*), whereby the bottom abutting section (5*b*) closes the bottom portion (3*a*). At this stage, only the adhesive injecting hole (5*d*) is open.

Thus, the lamp body (1) is provisionally fixed in a state in which the pinch seal portion (1*a*) and the lead rods (1*b*) are positioned relative to the lamp mount portion (3) of the reflector (2) via the pinch seal support (4) and the lead rod support (5), respectively.

In recent years, in accordance with the improvement in lamp production technique, the position deviation of the filament (7) is extremely small, so that the variations among the lamp bodies (1) are small. Therefore, focalization can be performed simply by mounting the pinch seal portion (1*a*) with the pinch seal support and the lead rod support onto a predetermined position in the reflector (2) as described above. This eliminates the conventional need for focalization by a three-dimensional and oscillating movement.

Thereafter, an inorganic adhesive (8) is injected into the lamp mount portion (3) through the adhesive injecting hole (5*d*) of the lead rod support (5). Due to presence of the opening/closing portion (4*c*) of the pinch seal support (4), the inorganic adhesive (8) is stopped from overflowing into the concave reflecting section (2*a*), so that a sufficient amount of adhesive (8) can be injected without worrying about contamination in the concave reflecting section (2*a*). Similarly, since the bottom aperture (3*b*) is also closed by the lead rod support (5), the inorganic adhesive (8) does not leak out through the bottom aperture (3*b*), either.

The lamp body (1) is held at a predetermined position in the lamp mount portion (3) by the pinch seal support (4) and the lead rod support (5) even after injection of the adhesive (8). This eliminates the conventional need for holding the lamp body (1) until the inorganic adhesive (8) hardens to some extent. Therefore, the next operation can be started by leaving the lamp body (1) alone, thereby improving the productivity.

Further, since a sufficient amount of the inorganic adhesive (8) can be injected, heat conduction between the pinch seal portion (1*b*) and the lamp mount portion (3) of the reflector (2) is improved, thereby a high wattage lamp can be produced by good heat release even without forcible cooling.

Here, although the number of components is increased as compared with the conventional halogen lamp, the overall costs in producing the halogen lamp of the present invention are lower than those in producing the conventional halogen lamp because of the aforementioned improvement in the productivity and non-use of an unexpectedly expensive release paper.

As shown and described above, the present invention provides a halogen lamp with reflector which allows the pinch seal portion to be fitted onto the lamp mount portion of the reflector simply by inserting the lamp body with the pinch seal support and the lead rod support into the lamp mount portion, thrashes the cost and prevents the inorganic adhesive from contaminating the concave reflecting section of the reflector, and is suitable for achieving high wattage.

What is claimed is:

1. A halogen lamp with reflector, comprising:

a halogen lamp body;

a reflector having a tubular lamp mount portion for fitting a pinch seal portion of said halogen lamp body;

a pinch seal support fitted onto the pinch seal portion and including an opening/closing portion that closes a front opening of said lamp mount portion on a concave reflecting section side, reflector abutting pieces extending from the opening/closing portion and abutting an inside surface of the lamp mount portion, and pinch seal portion abutting pieces extending from edges of an insertion hole which is formed in the opening/closing portion and through which said pinch seal portion is inserted, to hold the pinch seal portion from both sides thereof;

an insulating lead rod support that is fitted to lead rods of the halogen lamp and includes an adhesive injecting hole formed therethrough and closes a bottom aperture of said lamp mount portion; and an inorganic adhesive injected into the pinch seal portion.

2. A halogen lamp with reflector as set forth in claim 1, wherein the pinch seal support is made of metal.

3. A halogen lamp with reflector as set forth in claim 1, wherein the reflector abutting pieces have a length such that, when the insulating lead rod support is inserted into the bottom aperture of the lamp mount portion, top ends of the reflector abutting pieces abut the insulating lead rod support and the opening/closing portion closes the front opening of the lamp mount portion.

* * * * *